US007791042B2

(12) United States Patent
McCauley et al.

(10) Patent No.: US 7,791,042 B2
(45) Date of Patent: Sep. 7, 2010

(54) METHOD AND APPARATUS FOR SELECTIVELY PERFORMING CHEMICAL IONIZATION OR ELECTRON IONIZATION

(75) Inventors: Edward B. McCauley, Cedar Park, TX (US); Scott T. Quarmby, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 692 days.

(21) Appl. No.: 11/601,037

(22) Filed: Nov. 17, 2006

(65) Prior Publication Data

US 2008/0116369 A1 May 22, 2008

(51) Int. Cl.
*H01J 27/00* (2006.01)

(52) U.S. Cl. ..... 250/427; 250/281; 250/282; 250/283; 250/285; 250/288; 73/23.35; 95/82; 95/89; 96/105

(58) Field of Classification Search ..... 250/281, 250/282, 283, 285, 288, 427; 73/23.35; 95/82, 95/89; 96/105

See application file for complete search history.

(56) References Cited

U.S. PATENT DOCUMENTS 3,886,365 A 5/1975 Kruger et al.
3,992,632 A 11/1976 Kruger et al.
4,105,916 A * 8/1978 Siegel ..... 250/282
RE30,171 E 12/1979 Kruger et al.
4,266,127 A 5/1981 Chang
4,388,531 A 6/1983 Stafford et al.
6,515,279 B1 * 2/2003 Baykut ..... 250/285
6,596,989 B2 * 7/2003 Kato ..... 250/288
7,323,682 B2 * 1/2008 McCauley et al. ..... 250/287
2006/0016978 A1 1/2006 McCauley et al.

* cited by examiner

*Primary Examiner*—Jack I Berman
*Assistant Examiner*—Hanway Chang
(74) *Attorney, Agent, or Firm*—Sharon Upham; Michael C. Staggs

(57) ABSTRACT

An ion source includes structure having separate first and second ion volumes therein, and electron source structure having first and second portions that selectively supply electrons to the first and second ion volumes, respectively. The electron source structure has a first operational mode in which the second portion substantially prevents a supply of electrons to the second ion volume and in which electrons are supplied to the first ion volume under control of the first portion, and has a second operational mode in which the first portion substantially prevents a supply of electrons to the first ion volume and in which electrons are supplied to the second ion volume under control of the second portion.

16 Claims, 4 Drawing Sheets

METHOD AND APPARATUS FOR SELECTIVELY PERFORMING CHEMICAL IONIZATION OR ELECTRON IONIZATION

TECHNICAL FIELD

This invention relates in general to ion sources and, more particularly, to ion sources configured to selectively perform chemical ionization or electron ionization.

BACKGROUND

Existing mass spectrometers have an ion source that produces ions of a sample material. These ions are then processed by a mass analyzer which includes a mass detector. Some existing ion sources produce ions using a technique known as electron ionization (EI). Particles of a sample material that are referred to as analytes are supplied in a gas phase to an ion volume having a relatively low pressure, and an electron beam is also supplied to the ion volume. The electrons directly strike the sample analytes, and the resulting energy exchange is sufficient to cause ionization, producing ions characteristic of the sample material. These ions are then supplied to the mass analyzer.

A different type of ion source produces ions using a technique known as chemical ionization (CI). The analytes of the sample material are supplied in a gas phase to an ion volume, and a reagent gas such as methane is also supplied to the ion volume. Further, an electron beam is supplied to the ion volume. The ion volume is configured so that the inflow of the reagent gas maintains a relatively high pressure within the ion volume, thereby ensuring a density for the reagent gas that increases the probability of collisions between the incoming electrons and the molecules of the reagent gas. When electrons collide with the molecules of the reagent gas, the collisions produce ions of the reagent gas. The ions of the reagent gas then react with the analytes of the sample gas, in order to form further ions that are characteristic of the sample material. These further ions are then supplied to the mass analyzer.

It is often advantageous to collect data regarding a particular sample using both EI and CI. Although it is possible to use one mass analyzer for EI and a different mass analyzer for CI, it can be advantageous to use the same mass analyzer for both EI and CI. Due to factors such as the fact that CI and EI need to be carried out at different pressures, early attempts to switch a mass spectrometer between EI and CI involved physically removing one type of ion source from the mass analyzer and replacing it with the other type of ion source. This included venting of the vacuum chamber that contained the ion source, and then reestablishing a vacuum after the ion sources were exchanged. This approach typically took one or more hours to carry out.

Subsequently, pressure interlocks were developed that permitted one type of ion source to be removed and replaced with the other type of ion source, without breaking the vacuum. This reduced the amount of time needed to exchange the ion sources, typically to several minutes. Ideally, however, it is desirable to be able to switch between EI and CI sufficiently quickly so that, for example, either EI or CI ionization techniques can be utilized within a single chromatographic run for different analytes, or so that both EI and CI spectra can be acquired within the elution time of individual analytes.

A later-developed ion source simultaneously carries out both CI and EI. The CI and EI ion volumes are maintained at different potentials, thereby making it possible to electromagnetically select ions from either ion volume for analysis, while excluding ions from the other ion volume. While this approach has been generally adequate for its intended purposes, it has not been entirely satisfactory in all respects. As one example, this approach continuously carries out both EI and CI ionization. This results in a relatively rapid buildup of contaminants on the surfaces of both ion volumes, and the contaminants act to reduce the sensitivity of the system. Consequently, the ion source must be disassembled on a relatively frequent basis in order to clean the interior surfaces of both ion volumes. Moreover, in this configuration, the electromagnetic selection of ions presents competing considerations. On the one hand, ions from the two ion volumes have overlapping kinetic energy distributions that make it difficult to completely exclude ions from one volume in favor the other. But on the other hand, if the electromagnetic fields used for selection are increased in an attempt to improve the separation, there is the possibility of compromising sensitivity in regard to ions that are being selected.

SUMMARY

One of the broader forms of the invention involves an apparatus with an ion source that includes structure having separate first and second ion volumes therein, and that includes electron source structure having first and second portions that selectively supply electrons to the first and second ion volumes, respectively. The electron source structure has a first operational mode in which the second portion substantially prevents a supply of electrons to the second ion volume and in which electrons are supplied to the first ion volume under control of the first portion, and further has a second operational mode in which the first portion substantially prevents a supply of electrons to the first ion volume and in which electrons are supplied to the second ion volume under control of the second portion.

Another of the broader forms of the invention involves an apparatus with a mass spectrometer that includes an ion source having structure defining separate first and second ion volumes therein, and a mass analyzer that is operatively cooperable with the ion source for receiving ions from each of the first and second ion volumes. The ion source includes electron source structure having first and second portions that selectively supply electrons to the first and second ion volumes, respectively. The electron source structure has a first operational mode in which the second portion substantially prevents a supply of electrons to the second ion volume and in which electrons are supplied to the first ion volume under control of the first portion, and further has a second operational mode in which the first portion substantially prevents a supply of electrons to the first ion volume and in which electrons are supplied to the second ion volume under control of the second portion.

Still another of the broader forms of the invention involves a method of operating an ion source having separate first and second ion volumes and having electron source structure with first and second portions that can selectively supply electrons to the first and second ion volumes. The method includes: operating the electron source structure in a first mode in which the second portion substantially prevents a supply of electrons to the second ion volume and in which electrons are supplied to the first ion volume under control of the first portion; and operating the electron source structure in a second mode in which the first portion substantially prevents a supply of electrons to the first ion volume and in which electrons are supplied to the second ion volume under control of the second portion.

DETAILED DESCRIPTION

Figure 1:
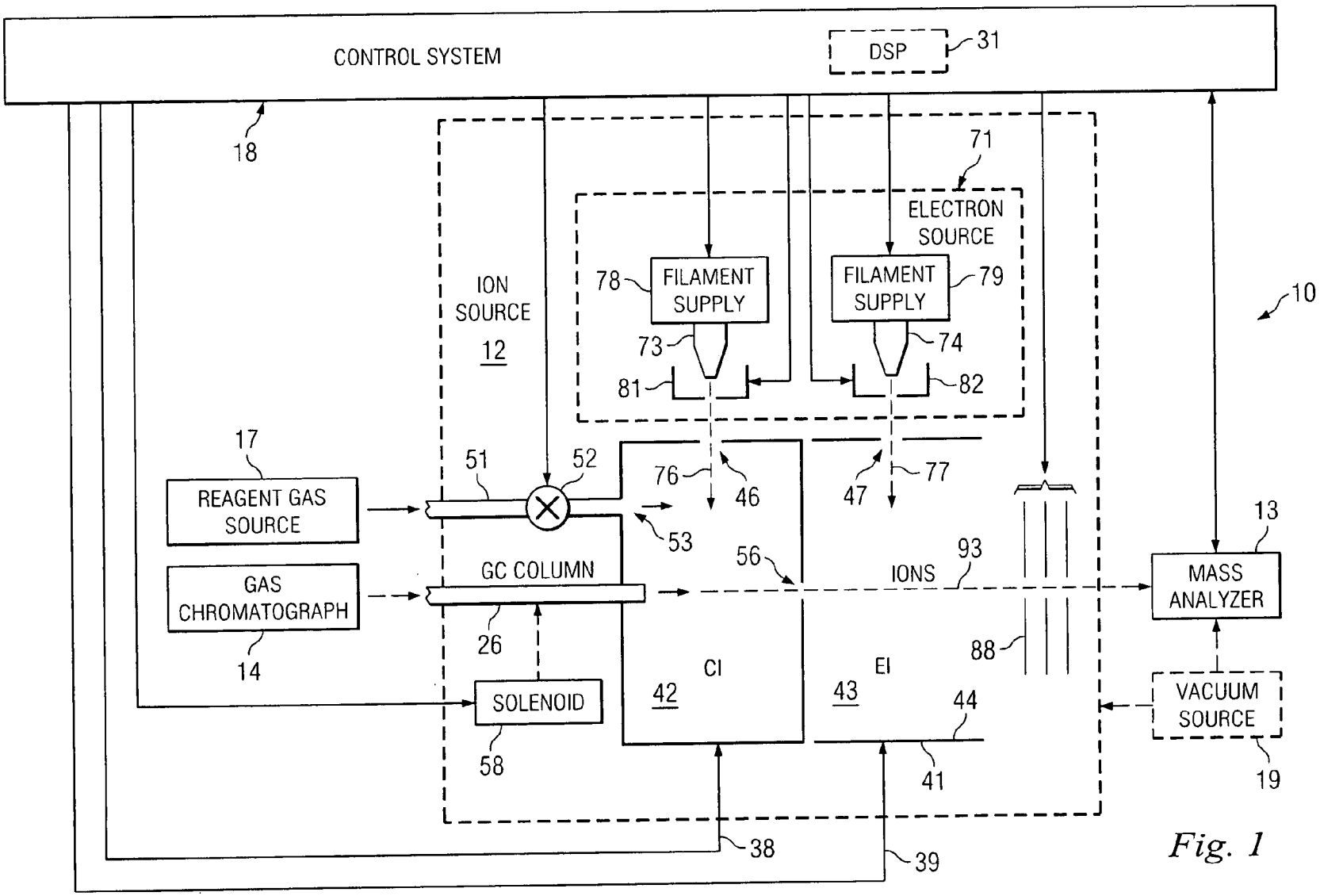
FIG. 1 is a block diagram of a mass spectrometer that embodies aspects of the present invention.

FIG. 1 is a block diagram of a mass spectrometer (MS) 10 that embodies aspects of the present invention. The mass spectrometer 10 includes an ion source 12, a mass analyzer 13, a gas chromatograph 14, a source 17 of a reagent gas, a control system 18, and a vacuum source 19.

The mass analyzer 13 is a type of device that is known in the art, and in fact could be any of a number of commercially-available devices. The mass analyzer 13 may include a not-illustrated device to separate ions based on their mass-to-charge ratio, examples of which include but are not limited to a quadrupole filter, a linear ion trap, a cylindrical ion trap, a three-dimensional ion trap, a Fourier transform ion cyclotron resonance filter, an electrostatic ion trap, a Fourier transform electrostatic filter, a time-of-flight filter, a quadrupole time-of-flight filter, a hybrid analyzer, or a magnetic sector. Further, the mass analyzer 13 may include a not-illustrated detector that can detect ions. Since the mass analyzer 13 in FIG. 1 is a known type of device, it is not described here in further detail.

The gas chromatograph 14 is also a known type of device, and could be any of a number of commercially-available devices. The gas chromatograph 14 serves as a source of particles of a sample material that are referred to as analytes. In particular, the gas chromatograph 14 outputs analytes that are atoms or molecules of the sample material in a gas phase. The sample analytes delivered by the gas chromatograph 14 travel through a gas chromatograph (GC) column 26 of a known type. For example, the GC column 26 may be a fused silica capillary tube of a type well known in the art.

The control system 18 includes circuitry of a known type, and is operatively coupled to various other components of the mass spectrometer 10, including the ion source 12 and the mass analyzer 13. In the disclosed embodiment, the control system 18 includes a digital signal processor (DSP) that is indicated diagrammatically at 31. The DSP 31 executes a software program that determines how the system 18 controls other components of the mass spectrometer 10. The DSP 31 could alternatively be a microcontroller, or some other form of digital processor. As another alternative, the DSP 31 could be replaced with a state machine or a hardwired circuit.

The reagent gas source 17 is also a known type of device, and produces a flow of a reagent gas such as methane. The vacuum source 19 is a known type of system, and is operatively coupled to both the ion source 12 and the mass analyzer 13, in order to maintain a vacuum in interior regions of each during normal operation.

The ion source 12 has therein a housing 41 with two adjacent chambers that serve as respective ion volumes 42 and 43. The ion volumes 42 and 43 are electrically isolated from each other, as indicated diagrammatically in FIG. 1 by a small gap between the walls of ion volume 42 and the walls of ion volume 43. The control system 18 has two outputs that are coupled at 38 and 39 to the ion volumes 42 and 43, respectively, so that the control system 18 can selectively apply different potentials to the ion volumes 42 and 43. The ion volume 43 has a relatively large outlet opening 44 on a side thereof opposite from the ion volume 42, and facing the mass analyzer 13. The housing 41 has two openings 46 and 47 that each communicate with a respective one of the ion volumes 42 and 43. The openings 46 and 47 each serve as an electron inlet port, in a manner discussed later. A gas supply conduit 51 extends from the reagent gas source 17 to the housing 41, and an electrically-operated valve 52 is provided along the conduit to control gas flow through the conduit. The valve 52 is controlled by an output of the control system 18. The conduit 51 opens into the ion volume 42 through a gas inlet port 53.

Figure 2:
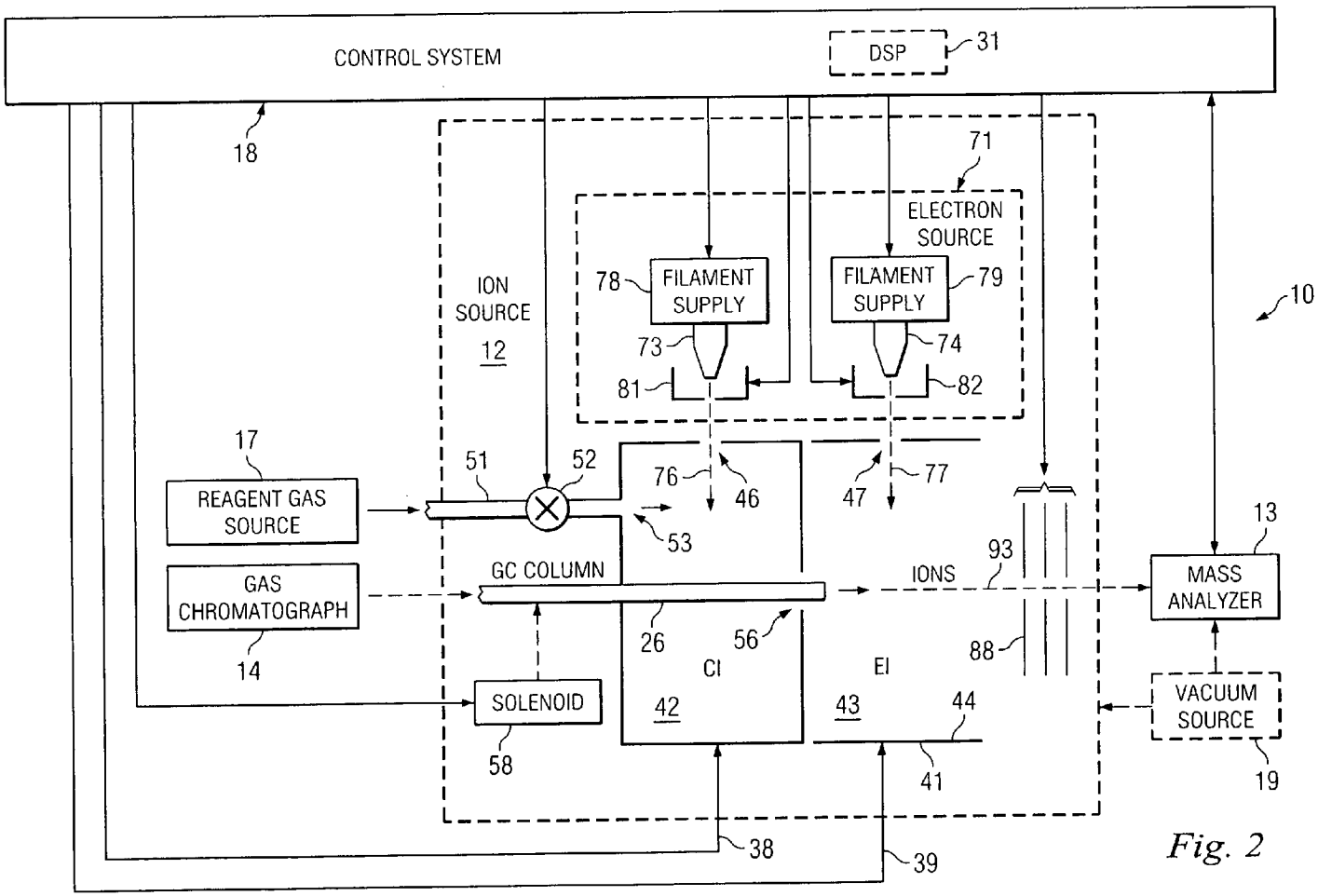
FIG. 2 is a block diagram of the mass spectrometer of FIG. 1, showing a component thereof in a different operational position.

The end of the GC column 26 remote from the gas chromatograph 14 has an end portion that projects a short distance into the ion volume 42 through an opening in the housing 41. The GC column 26 enters the ion volume 42 on a side thereof opposite from the ion volume 43. The housing 41 has a wall between the ion volumes 42 and 43, and a passage 56 is provided through this wall, at a location aligned with the end portion of the GC column 26. The end portion of the GC column 26 is supported for axial movement relative to the housing 41 between a normal position and an extended position. The normal position is shown in FIG. 1. FIG. 2 is a block diagram of the mass spectrometer 10 that is effectively identical to FIG. 1 except that it shows the GC column 26 in its extended position. As shown in FIG. 2, when the GC column 26 is in its extended position, the end portion extends through the passage 56 and projects a short distance into the ion volume 43. The ion source 12 includes an electrically-controlled solenoid 58 that is operatively coupled to the GC column 26, and that is controlled by the control system 18. The solenoid 58 effects movement of the GC column 26 between the normal position of FIG. 1 and the extended position of FIG. 2.

Since the GC column 26 in FIGS. 1 and 2 is a flexible fused silica capillary, a not-illustrated curved tube could optionally be provided to couple the outlet of the gas chromatograph 14 to the inlet of the GC column 26. The curved tube would have an inlet that is oriented orthogonal to its outlet and the ion beam, thereby permitting the gas chromatograph 14 to be positioned in relation to the housing 41 so that the mass spectrometer 10 has an overall configuration that is more compact.

Although the embodiment of FIGS. 1-2 uses the solenoid 58 to effect movement of the GC column 26, it would alternatively be possible to use a control valve or any other suitable device or mechanism to effect this movement. As still another alternative, the solenoid 58 could optionally be omitted, and the GC column 26 could be fixed in the position shown in FIG. 1.

The ion source 12 includes near the housing 41 an electron source 71 having two spaced filaments 73 and 74 of a known type. The filaments 73 and 74 are each aligned with a respective one of the electron inlet ports 46 and 47 in the housing 41. When energized, the filaments 46 and 47 produce respective beams of electrons 76 and 77 that can propagate into the respective ion volumes 42 and 43 through the respective ion inlet ports 46 and 47. The electron source 71 includes two filament supplies 78 and 79 of a known type. The filament supplies 78 and 79 each operate a respective one of the filaments 73 and 74. The filament supplies 78 and 79 are controlled by respective outputs of the control system 18, so that the control system can selectively turn each of the filaments 73 and 74 on and off. Alternatively, it would be possible to use only one filament supply to control both of the filaments 73 and 74.

The electron source further includes two electron gates 81 and 82 of a known type. The electron gates 81 and 82 are each provided between a respective filament 73 or 74 and a respective electron inlet port 46 or 47. Each of the electron gates 81 and 82 is controlled by a respective output of the control system 18. The control system 18 can thus selectively and independently "open" and "close" each of the electron gates 81 and 82. When either electron gate is open, the associated electron beam 76 or 77 propagates through that gate and into the associated ion volume 42 or 43. On the other hand, when either electron gate is closed, it interrupts the associated electron beam 76 or 77, so that the electron beam is inhibited from traveling to and entering the associated ion volume.

The ion source 12 further includes a set of lens elements 88 of a known type. The lens elements 88 are disposed between the ion volume 43 and the mass analyzer 13. The lens elements 88 are controlled by one or more outputs of the control system 18.

The ion volume 42 is used for chemical ionization (CI), and the ion volume 43 is used for electron ionization (EI). The general principles of CI and EI are known in the art, and are therefore not described here in detail. The ion source 12 has a CI mode of operation in which it carries out CI in the ion volume 42 but not EI in the ion volume 43, and has an EI mode of operation in which it carries out EI in the ion volume 43 but not CI in the ion volume 42. During normal operation, the valve 52 remains open to allow a continuous flow of the reagent gas to pass through the conduit 51 and into the ion volume 42. As shown diagrammatically in FIG. 1, the CI ion volume 42 has only a few very small openings. Thus, due to these relatively small openings and also the flow of reagent gas into the interior of the ion volume 42, the ion volume 42 is maintained at a relatively high pressure in comparison to the vacuum maintained by the vacuum source 19 in the region around the housing 41; For example, the pressure within the ion volume 42 is typically about 0.1 Torr during normal operation of the ion source 12.

Throughout normal operation, the solenoid 58 remains disabled, so that the GC column 26 is maintained in the normal position depicted in FIG. 1. The gas chromatograph 14 contains a sample material, and produces analytes of the sample material such as atoms or molecules thereof, which are supplied through the GC column 26 in a gas phase to the ion volume 42. In the CI mode, the electron gate 82 is kept closed in order to prevent the electron beam 77 from entering the ion volume 43 to cause EI. When the electron gate 81 is open and allows the electron beam 76 to enter the ion volume 42, the electrons of the beam 76 collide primarily with the high pressure reagent gas to form ions of the reagent gas. The relatively high pressure within the ion volume 42 ensures a density of the reagent gas that promotes such collisions in order to produce ions of the reagent gas. The ions of the reagent gas then react with the analytes of the sample gas in order to form ions characteristic of the individual analytes. Gas flowing out of the ion volume 42 carries with it these ions, and some of these ions exit through the passage 56. The control system applies different potentials to the ion volumes 42 and 43 through the control lines 38 and 39, and also applies at least one potential to the lens elements 88. These potentials at the ion volumes and lens elements extract and focus the ions of sample material generated within the volume 42. In particular, the ions travel along a path 93 from the ion volume 42, through the passage 56, through the ion volume 43, and through the lens elements 88 to the mass analyzer 13. The path of ion travel 93 is approximately perpendicular to each of the electron beams 76 and 77. As mentioned above, while CI is occurring in this manner, EI is not carried out within the ion volume 43.

To perform EI, the electron gate 81 is closed so that the associated electron beam 76 does not enter the ion volume 42 and cause ionization there. Instead, the analytes of the sample material entering the ion volume 42 from the GC column 26 travel across the ion volume 42, and then pass through the passage 56 and into the ion volume 43. The electron gate 82 is selectively opened in order to permit the electron beam 77 to enter the ion volume 43, where the electrons of the beam 77 directly strike analytes of the sample material. The resulting energy exchange is sufficient to cause ionization that yields ions characteristic of the separated analytes. The control system applies different potentials to the ion volumes 42 and 43 through the control lines 38 and 39, so that the ion volume 42 acts as a repeller that causes ions to be urged away from it. The control system 18 also applies at least one potential to the lens elements 88. These potentials at the ion volumes and the lens elements extract and focus the ions of sample material generated within the ion volume 43, causing them to travel along the path 93 from the ion volume 43 through the lens elements 88 to the mass analyzer 13. Since the ion volume 43 has a relatively large opening 44 on the side thereof facing the mass analyzer 13, the pressure within the ion volume 43 is relatively close to the vacuum maintained around the housing 41 by the vacuum source 19. Consequently, the pressure within the ion volume 43 is lower than the pressure within the ion volume 42, and is typically less than about $10^{-2}$ Torr. Stated differently, the vacuum source 19 has sufficient pumping conductance so that, in conjunction with the relatively large size of the opening 44, the pressure of the reagent gas that enters the ion volume 43 is sufficiently low so as to preclude any significant formation of CI spectra in the EI ion volume 43.

As mentioned above, the ion source 12 has a CI mode of operation, and an EI mode of operation. During each of these modes, the filament supplies 78 and 79 are both continuously activated by the control system 18, so that the filaments 73 and 74 are each continuously producing their respective electron beams 76 and 77. Alternatively, however, it would be possible to selectively activate and deactivate the filament supplies 78-79 and thus the filaments 73 and 74, as needed. During the CI mode, the electron gate 82 is kept continuously closed, to prevent the electron beam 77 from entering the ion volume 43 and causing EI there. In addition, the electron gate 81 is alternatingly opened and closed in a pulsed, periodic manner, as discussed later. Thus, the electron gate 81 alternately permits and prevents entry of the electron beam 76 into the ion volume 42 in order to effect CI there. Conversely, during the EI mode, the electron gate 81 is kept continuously closed, to prevent the electron beam 76 from entering the ion volume 42 and causing CI there. In addition, the electron gate 82 is alternatingly opened and closed in a pulsed, periodic manner, as discussed later. Thus, the electron gate 82 alternately permits and prevents entry of the electron beam 77 into the ion volume 43 in order to effect EI there.

As mentioned above, the electron gate 81 is alternatingly opened and closed in a periodic manner during the CI mode, so that the electron beam 76 is intermittently supplied to the ion volume 42 in a pulsed manner. Similarly, the electron gate 82 is alternatingly opened and closed in a periodic manner during the EI mode, so that the electron beam 77 is intermittently supplied to the ion volume 43 in a pulsed manner. The periodic operation of either electron gate 81 or 82 can be carried out with a duty cycle that is fixed, or that is dynamically varied by dynamically varying the frequency and/or the pulse width. This allows quantitative adjustments of ion populations. For mass spectrometers of the beam type, such as quadrupoles or sector instruments, this adjustment can be made on a mass-to-mass basis during mass analysis. Regardless of whether the duty cycle is fixed or varied dynamically, for duty cycles between 0% and 100%, the frequency is selected so that, at all times during normal operation, the frequency is greater than or equal to the scan frequency of the mass analyzer 13. This can allow a sufficient number of ion pulses for adequate peak profiling and centroiding.

Suitable techniques for effecting pulsed operation of an electron gate are known in the art, for example as discussed in McCauley US Patent Application Publication No. 2006/0016978 A1. As an alternative to pulsed operation of the electron gates 81 and 82, it would be possible to keep the electron gate 81 continuously open during the CI mode, and/or to keep the electron gate 82 continuously open during the EI mode. However, the ionization processes carried out within each ion volume inherently cause contaminants such as ions and molecules to collect on interior surfaces of that ion volume. Performing continuous ionization would cause these contaminants to build up at a relatively rapid rate. In contrast, pulsed operation of the electron gates 81 and 82 significantly reduces the cumulative amount of time during which ionization is actually performed within each ion volume, thereby significantly decreasing the rate at which contaminants build up on the interior surfaces of either ion volume. This in turn permits the ion source 12 to be operated for a significantly longer period of time before it becomes necessary to take it offline, open it, and clean the ion volumes 42 and 43. Pulsed operation of the electron gates permits adjustment of the duty cycle of the electron beam to reduce the effective electron current to the minimum level that produces statistically valid data. This minimizes the rate of contamination. For example, a 100 ng chromatographic peak can be limited to producing ions equivalent to a 1 ng peak by applying a 1% duty cycle to the electron beam. Generally, above 1 ng of analyte, data precision for full scan quadrupole GC/MS is not limited to ion statistics, but is limited by other factors, such as injection-to-injection repeatability. Pulsed operation of the electron gates also provides other benefits, such as increased dynamic range.

Moreover, by using the gates 81 and 82 to selectively supply a pulsed electron beam to one ion volume, while inhibiting the supply of an electron beam to the other ion volume, EI and CI ions can be completely separated from each other in time, with little or no tradeoff in sensitivity. This temporal separation also allows optimum potentials to be used in each mode for the lens elements 88 and the ion volumes 42 and 43. Thus, relatively pure spectra are obtained in each of the CI mode and the EI mode.

The configuration of the ion source 12 permits it to be relatively rapidly switched between the CI mode and the EI mode, through appropriate control of the electron gates 81 and 82. At the same time, pulsing the active gate 81 or 82 using a variable duty cycle allows quantitative reductions in ion populations that can be re-normalized to their original intensities by the firmware or software executed by the DSP 31. Thus, for example, if the active gate is pulsed with a 1% duty cycle so that the ion population is 1% of what it would be if the duty cycle were 100% (or in other words if the electron beam was on continuously), the DSP 31 can take the measured results and calculate what the ion population would have been at a 100% duty cycle (or some other duty cycle). The rapid switching between EI and CI permits both EI and CI spectra to be collected quickly. Where the mass spectrometer 10 is attempting to confirm that a sample material is in fact a particular target material, the control system 18 can, for example, operate the ion source 12 in the EI mode and then, in dependence on data collected during the EI mode, automatically switch the ion source to the CI mode in order collect data regarding selected ions. That is, the system can selectively create ions in the ion volume 42 that are dependant on the results obtained from ions previously created in the ion volume 43, or vice versa. The system might perform CI only if certain interesting EI spectra were observed, or conversely might perform EI only if certain interesting CI spectra were observed. Characteristics observed in one mode, such as peak intensity, retention time, ion ratios, or the appearance of specific ions, could influence whether the other mode was entered at all and, if so, what occurred in the latter mode.

As explained earlier, the solenoid 58 remains disabled during normal operation, and keeps the GC column 26 in the position shown in FIG. 1 while the ion source 12 switches between its CI mode and EI mode. However, there are situations where it is recognized that CI will not be needed and that only EI will be performed. For those situations, the valve 52 can be closed to halt the flow of reagent gas through the ion volumes 42 and 43, in order to preclude the possibility of any CI spectra in the ion volume 43 during the EI mode. The filament 73 can be turned off, in order to conserve power and prolong the operational lifetime of the filament. Further, the solenoid 58 can be actuated in order to move the GC column 26 from the normal position of FIG. 1 to the extended position of FIG. 2. The ion source 12 can then be operated in an EI-only mode, thereby permitting EI to be carried out with even higher sensitivity. For example, the analytes of the sample material would not have to first travel through the ion volume 42 and then the passage 56 in order to reach the ion volume 43, and this serves to reduce surface activity that can influence sensitivity. Further, since the valve 52, the filament supply 78, and the solenoid 58 are each controlled electrically, the ion source 12 can be switched between the normal CI/EI mode of FIG. 1 and the EI-only mode of FIG. 2 without any need to break vacuum.

Figure 3:
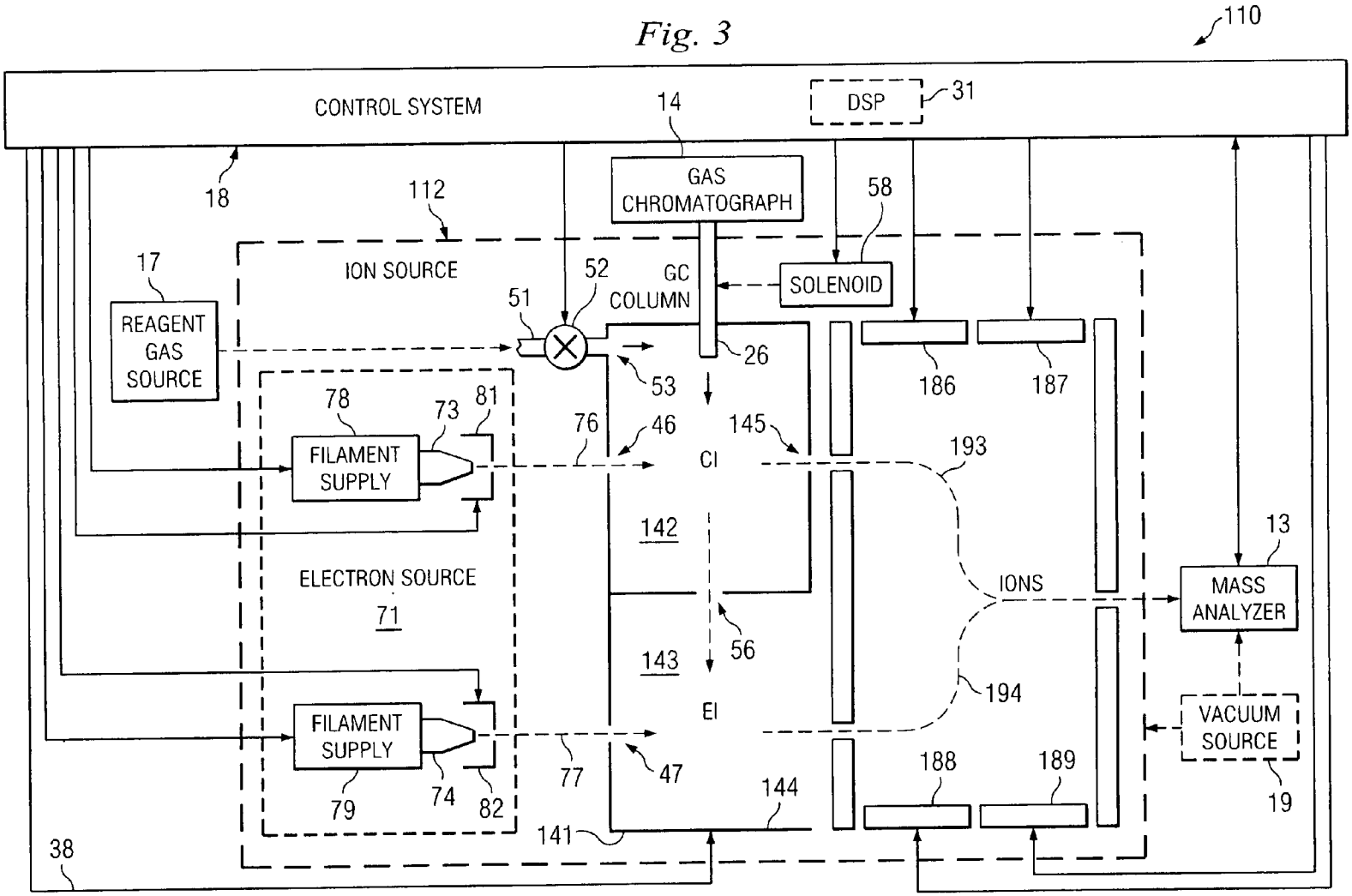
FIG. 3 is a block diagram of a mass spectrometer that is an alternative embodiment of the mass spectrometer of FIGS. 1-2.

FIG. 3 is a block diagram of a mass spectrometer 110 that is an alternative embodiment of the mass spectrometer 10 of FIGS. 1-2. Components in FIG. 3 that are equivalent to components in FIGS. 1-2 are identified with the same reference numerals. The discussion below focuses primarily on differences between the mass spectrometers 10 and 110.

The mass spectrometer 110 of FIG. 3 has an ion source 112 that includes a housing 141 with two chambers therein that serve as respective ion volumes 142 and 143. The ion volume 142 is used for CI, and the ion volume 143 is used for EI. Between the ion volumes 142 and 143 is a housing wall that has the passage 56 extending therethrough. In the ion source 12 of FIGS. 1-2, the EI ion volume 43 is located between the CI ion volume 42 and the mass analyzer 13. In contrast, in the ion source 112 of FIG. 3, the CI ion volume 142 and the EI ion volume 143 are arranged in a side-by-side configuration with respect to the mass analyzer 13. The ion volume 142 has a relatively small ion outlet 145 on a side thereof facing the mass analyzer 13, and the ion volume 143 has a relatively large ion outlet 144 on a side thereof facing the mass analyzer 13. The ion volumes 142 and 143 have respective electron ports 46 and 47 that permit entry of the respective electron beams 76 and 77 from the electron source 71. In the embodiment of FIG. 3, the ion volumes 142 and 143 are not electrically isolated, and both receive the same potential from the control system 18 through a single control line 38. Ion volume 143 could also optionally include a not-illustrated repeller of a known type, to aid in focusing ions out of that ion volume.

FIG. 3 is a block diagram and, in order to facilitate an understanding of the embodiment shown in FIG. 3, electron source 71 is shown on a side of the housing 141 opposite from the mass analyzer 13. The electron source 71 is thus readily visible in FIG. 3, to facilitate an understanding of the ion source 112. However, in an actual implementation, the electron source 71 could be positioned so that the electron beams 76 and 77 are each oriented approximately perpendicular to the plane of FIG. 3. The electron beams 76 and 77 would thus not emit electrons directly toward the mass analyzer 13. In each of the CI mode and EI mode, the electron source 71 of FIG. 3 is operated in the same manner described above in association with the embodiment of FIGS. 1-2.

The GC column 26 extends a small distance into the ion volume 142, on a side of the ion volume 142 opposite from the passage 56. The GC column 26 is shown in its normal operational position in FIG. 3. It can be moved by the solenoid 58 to an extended position that is not separately illustrated, but that is equivalent to the extended position shown in FIG. 2. It will be noted that sample analytes entering the ion volume 142 from the GC column 26 are not traveling in a direction toward the mass analyzer 13, but instead travel transversely to that direction. This has the advantage of reducing the number of neutrals (such as excited helium atoms) that travel to and enter the mass analyzer 13. More specifically, with reference to FIG. 3, the neutrals would have to significantly change direction in order to travel toward the mass analyzer 13. But since the neutrals are not significantly influenced by the electric fields provided for the ions, few of the neutrals will change direction. Thus, in the mass analyzer 13 of FIG. 3, neutral noise is reduced. Also, the off-axis orientation of the GC column 26 may permit the ion source to fit more compactly within many mass spectrometers. Moreover, if the mass analyzer 13 has a mass filter, this may reduce the cost of the mass filter, for example by eliminating the need for complicated bent multipoles that are expensive.

The lens elements 88 in the ion source 12 of FIGS. 1-2 have been replaced in FIG. 3 with a set of deflection electrodes 186-189 that are controlled by the control system 18. The deflection electrodes produce electromagnetic fields that influence the paths of movement of ions traveling from the ion volumes 142 and 143 to the mass analyzer 13. In particular, in the CI mode, the deflection electrodes 186-189 can establish a field that causes ions from the CI ion volume 142 to travel along a path 193 from the ion volume 142 through the ion outlet 145 to the mass analyzer 13. In the CI mode, the electron beam 77 will be turned off, and very few ions will be present in the EI ion volume 143. And to the extent some ions may be present in the ion volume 143, the field produced by electrodes 186-189 will deflect these ions away from the mass analyzer 13 along a not-illustrated path of travel. On the other hand, in the EI mode, the deflection electrodes 186-189 will generate a different field that causes ions produced within the EI ion volume 143 to travel along a path 194 from the ion volume 143 through the ion outlet 144 to the mass analyzer 13. In the EI mode, the electron beam 76 will be turned off, and very few ions will be generated within the CI ion volume 142. And to the extent some ions may be present in the ion volume 142, the field produced by electrodes 186-189 will deflect these ions away from the mass analyzer 13 along a not-illustrated path of travel.

Figure 4:
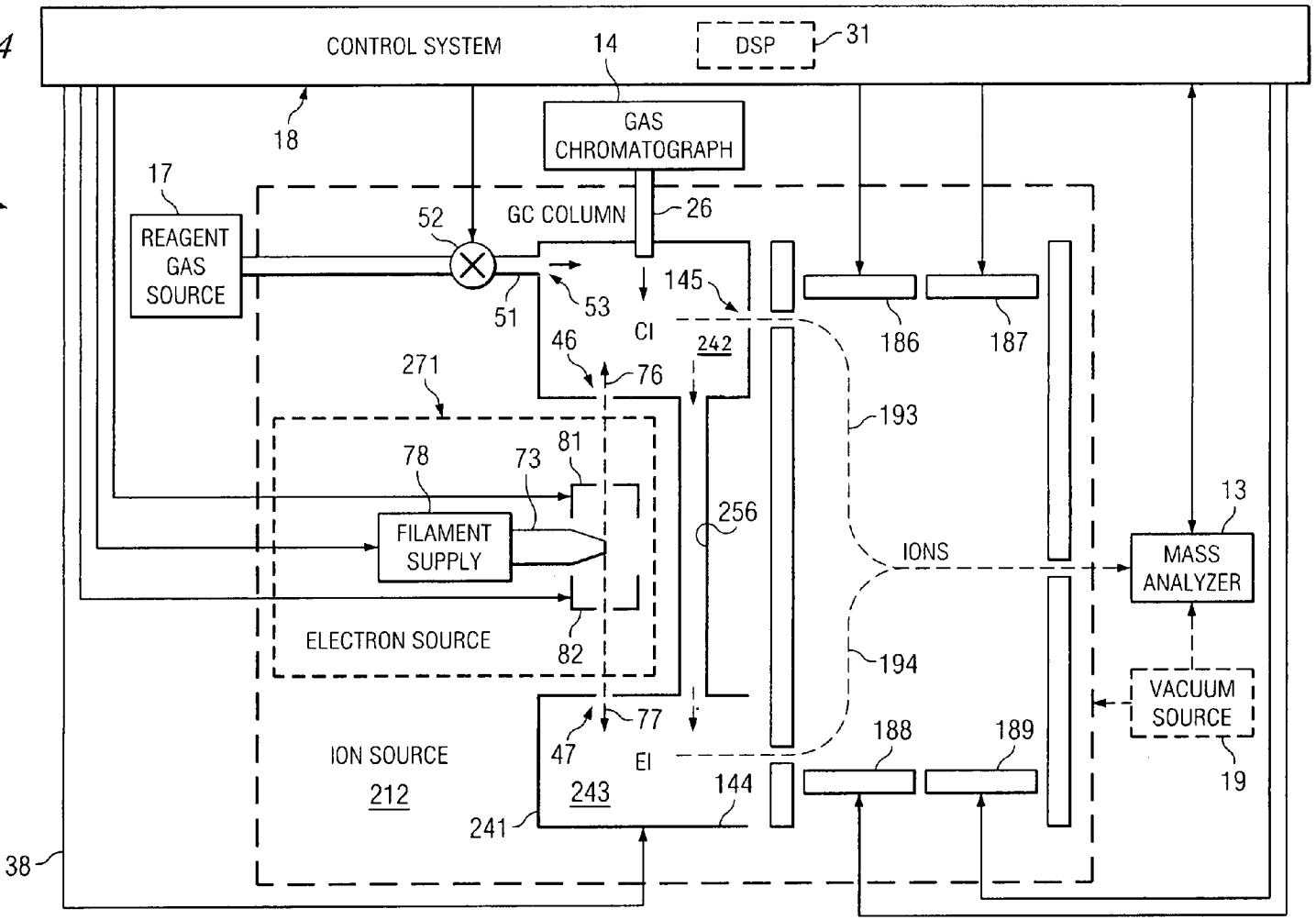
FIG. 4 is a block diagram of a mass spectrometer that is an alternative embodiment of the mass spectrometer of FIG. 3.

FIG. 4 is a block diagram of a mass spectrometer 210 that is an alternative embodiment of the mass spectrometer 110 of FIG. 3. Components in FIG. 4 that are equivalent to components in FIG. 3 are identified with the same reference numerals. The discussion below focuses primarily on differences between the mass spectrometers 110 and 210.

The mass spectrometer 210 includes an ion source 212 having a housing 241 with spaced chambers that serve as respective ion volumes 242 and 243. The ion volume 242 is used for CI, and the ion volume 243 is used for EI. The housing 241 has a passage 256 that extends between the spaced ion volumes 242 and 243, to provide communication between the ion volumes.

The ion source 212 includes an electron source 271 that is disposed between the ion volumes 242 and 243. The electron source 271 has a single filament supply 78 and a single filament 73. The filament 73 generates both of the electron beams 76 and 77, and the beams 76 and 77 propagate away from the filament 73 in opposite directions toward the respective ion volumes 242 and 243. The electron gates 81 and 82 are arranged on opposite sides of the filament 73. When either of the electron gates 81 and 82 is closed, it operates to repel electrons, and thus effectively serves as a reflector.

In other words, when the gate 81 is open and the gate 82 is closed, electrons of the beam 77 that travel from the filament 73 toward the gate 82 are repelled or reflected by the gate 82, and then travel in the opposite direction through the gate 81 as part of the electron beam 76. Similarly, when the gate 82 is open and the gate 81 is closed, electrons of the beam 76 that travel from the filament 73 toward the gate 81 are repelled or reflected by the gate 81, and then travel in the opposite direction through the gate 82 as part of the electron beams 77.

In the embodiment of FIG. 4, the CG column 26 is stationary with respect to the ion volume 242. Alternatively, however, the GC column 26 in FIG. 4 could be aligned with the passage 256, and the GC column 26 could be supported for movement by a not-illustrated solenoid between normal and extended positions, in a manner similar to that disclosed above in association with the embodiments of FIGS. 1-3.

Although several selected embodiments have been illustrated and described in detail, it will be understood that they are exemplary, and that a variety of substitutions and alterations are possible without departing from the spirit and scope of the present invention, as defined by the following claims.

What is claimed is:

1. An apparatus comprising an ion source that includes:

structure having separate first and second ion volumes therein;

an electron source structure having first and second portions with each of the first and second portions additionally configured with electron gates that selectively supply electrons to the first and second ion volumes, respectively, the electron source structure having a first operational mode in which the second portion substantially prevents a supply of electrons to the second ion volume and in which electrons are supplied to the first ion volume under control of the first portion, and having a second operational mode in which the first portion substantially prevents a supply of electrons to the first ion volume and in which electrons are supplied to the second ion volume under control of the second portion; and wherein the structure with the ion volumes includes a passage that provides communication between the first and second ion volumes, sample supply structure that facilitates a supply to the first ion volume of particles of a sample material, and gas supply structure that facilitates a supply of a reagent gas to the first ion volume;

wherein ionization that occurs within the first ion volume is chemical ionization; and wherein ionization that occurs within the second ion volume is electron ionization; and wherein the sample supply structure includes a gas chromatography column supported for movement between first and second positions in which the column emits the particles of the sample material in the first ion volume and in the second ion volume, respectively.

2. An apparatus according to claim 1, wherein during the first operational mode the first portion dynamically varies the supply of electrons to the first ion volume; and wherein during the second operational mode the second portion dynamically varies the supply of electrons to the second ion volume.

3. An apparatus according to claim 2, wherein during the first operational mode the first portion alternately permits and substantially prevents the supply of electrons to the first ion volume; and wherein during the second operational mode the second portion alternately permits and substantially prevents the supply of electrons to the second ion volume.

4. An apparatus according to claim 2, wherein during the first operational mode the first portion alternately permits and substantially prevents the supply of electrons to the first ion volume in a periodic manner; and wherein during the second operational mode the second portion alternately permits and substantially prevents the supply of electrons to the second ion volume in a periodic manner.

5. An apparatus according to claim 4, wherein the first portion alternates in the periodic manner at a first frequency with a first pulse width, at least one of the first frequency and the first pulse width being varied dynamically; and wherein the second portion alternates in the periodic manner at a second frequency with a second pulse width, at least one of the second frequency and the second pulse width being varied dynamically.

6. An apparatus according to claim 5, including a mass analyzer that has a scan frequency and that is operatively cooperable with the ion source for receiving ions from each of the first and second ion volumes, the first and second frequencies each being greater than or equal to the scan frequency.

7. An apparatus according to claim 1, wherein the electron source structure includes a filament that produces two beams of electrons for the first and second electron gates, respectively.

8. An apparatus according to claim 1, wherein the electron source structure includes:

a first filament that produces a first electron beam for the first electron gate; and a second filament that produces a second electron beam for the second electron gate.

9. An apparatus according to claim 1, wherein the second ion volume includes an outlet port, ions generated in the second ion volume traveling through the outlet port, and ions generated in the first ion volume traveling through the passage and then through the outlet port.

10. An apparatus according to claim 1, wherein the first ion volume includes for ions generated therein a first outlet port that is free of communication with the second ion volume; and wherein the second ion volume includes for ions generated therein a second outlet port that is free of communication with the first ion volume.

11. An apparatus according to claim 10, wherein ions travel through each of the first and second outlet ports in approximately a first direction; and wherein the sample supply structure introduces the particles of the sample material into the first ion volume in a second direction substantially different from the first direction.

12. An apparatus comprising a mass spectrometer that includes:

an ion source that includes structure having separate first and second ion volumes therein, and an electron source structure having first and second portions with each of the first and second portions additionally configured with electron gates that selectively supply electrons to the first and second ion volumes, respectively, the electron source structure having a first operational mode in which the second portion substantially prevents a supply of electrons to the second ion volume and in which electrons are supplied to the first ion volume under control of the first portion, and having a second operational mode in which the first portion substantially prevents a supply of electrons to the first ion volume and in which electrons are supplied to the second ion volume under control of the second portion;

wherein the structure with the ion volumes includes a passage that provides communication between the first and second ion volumes, sample supply structure that facilitates a supply to the first ion volume of particles of a sample material, and gas supply structure that facilitates a supply of a reagent gas to the first ion volume;

wherein ionization that occurs within the first ion volume is chemical ionization; and wherein ionization that occurs within the second ion volume is electron ionization; and wherein the sample supply structure includes a gas chromatography column supported for movement between first and second positions in which the column emits the particles of the sample material in the first ion volume and in the second ion volume, respectively; and a mass analyzer that is operatively cooperable with the ion source for receiving ions from each of the first and second ion volumes.

13. An apparatus according to claim 12, wherein during the first operational mode the first portion dynamically varies the supply of electrons to the first ion volume; and wherein during the second operational mode the second portion dynamically varies the supply of electrons to the second ion volume.

14. An apparatus according to claim 13, wherein during the first operational mode the first portion alternately permits and substantially prevents the supply of electrons to the first ion volume in a periodic manner; and wherein during the second operational mode the second portion alternately permits and substantially prevents the supply of electrons to the second ion volume in a periodic manner.

15. An apparatus according to claim 14, wherein the first portion alternates in the periodic manner at a first frequency with a first pulse width, at least one of the first frequency and the first pulse width being varied dynamically;

wherein the second portion alternates in the periodic manner at a second frequency with a second pulse width, at least one of the second frequency and the second pulse width being varied dynamically; and wherein the mass analyzer has a scan frequency, the first and second frequencies each being greater than or equal to the scan frequency.

16. An apparatus according to claim 12, including structure for controlling the second portion during the second operational mode in a manner that is a function of information obtained from the mass analyzer in response to ions previously produced by the ion source while operating in the first operational mode.

* * * * *